US008944178B1

(12) United States Patent
Seal

(10) Patent No.: US 8,944,178 B1
(45) Date of Patent: Feb. 3, 2015

(54) TONGUE PULLED SPREADER AND GRADER WITH AUXILIARY ELECTRIC MOTOR FOR LOWERING OR RAISING WHEELS

(71) Applicant: Domor Equipment, LLC, Eureka, IL (US)

(72) Inventor: Richard A. Seal, Picayune, MS (US)

(73) Assignee: Domor Equipment, LLC, Eureka, IL (US)

( * ) Notice: Subject to any disclaimer, the term of this patent is extended or adjusted under 35 U.S.C. 154(b) by 0 days.

(21) Appl. No.: 14/033,294

(22) Filed: Sep. 20, 2013

Related U.S. Application Data

(63) Continuation of application No. 12/948,963, filed on Nov. 18, 2010, now Pat. No. 8,544,558.

(60) Provisional application No. 61/403,878, filed on Sep. 23, 2010.

(51) Int. Cl.
*E02F 3/76* (2006.01)

(52) U.S. Cl.
CPC ..... *E02F 3/7663* (2013.01)
USPC ..... 172/799.5

(58) Field of Classification Search
CPC ..... E02F 3/7663; E02F 3/7622; E02F 3/7631; E02F 3/844; A01B 31/00; A01B 63/22
USPC ..... 172/799.5, 684.5, 445.1, 72, 383; 56/10.7
See application file for complete search history.

(56) References Cited

U.S. PATENT DOCUMENTS

| | | | | |
|---|---|---|---|---|
| 1,232,314 | A | | 7/1917 | Hubbard |
| 3,430,366 | A | | 3/1969 | King |
| 3,506,074 | A | * | 4/1970 | Abbott ..... 172/780 |
| 3,516,497 | A | * | 6/1970 | Waterson ..... 172/4.5 |
| 3,633,679 | A | * | 1/1972 | Dahlberg et al. ..... 172/123 |
| 3,640,346 | A | * | 2/1972 | Fueslein ..... 172/318 |
| 4,140,425 | A | | 2/1979 | Flippin |
| 4,189,009 | A | * | 2/1980 | Welch ..... 172/799.5 |
| 4,217,962 | A | | 8/1980 | Schaefer |
| 4,244,662 | A | * | 1/1981 | Olson ..... 404/118 |
| 4,260,290 | A | | 4/1981 | Flippin |
| 4,320,988 | A | | 3/1982 | Seal |
| 4,373,591 | A | | 2/1983 | Schaaf et al. |
| 4,490,929 | A | | 1/1985 | Lucas |
| 4,568,219 | A | | 2/1986 | Berry |
| 4,630,686 | A | | 12/1986 | Ausmus, Jr. |
| 4,655,297 | A | | 4/1987 | Bourgeois, Jr. |
| 4,700,786 | A | | 10/1987 | Berry |

(Continued)

*Primary Examiner* — Árpád Fábián-Kovács
(74) *Attorney, Agent, or Firm* — Garvey, Smith, Nehrbass & North, L.L.C.; Gregory C. Smith; Julia M. FitzPatrick

(57) ABSTRACT

A tongue pulled spreader and grader system having a pair of spaced apart sidewalls and cross beams to define a frame portion, a plurality of moveable or fixed blades extending between the sidewalls, each blade positionable along the length of each sidewall and fixed in position at a predetermined angle; a tongue for mounting the frame to the rear of a vehicle; a pair of wheels positioned on an axle on either side of the sidewalls; means for manually or hydraulically extending the wheels to a down position to make contact with a surface in order to transport the spreader and grader and for retracting the wheels to an up position so that the spreader and grader can undertake the grading process. The spreader and grader can attach to and be operated by ATVs, SUVs, light trucks, lawn tractors, sub compact tractors, side by side ATVs and fork trucks.

16 Claims, 7 Drawing Sheets

(56) References Cited

U.S. PATENT DOCUMENTS

| | | | | |
|---|---|---|---|---|
| 4,898,247 | A | 2/1990 | Springfield | |
| 4,917,533 | A | 4/1990 | Wilson | |
| 4,930,582 | A | 6/1990 | Goss | |
| 4,976,052 | A | 12/1990 | Jeane | |
| 5,191,943 | A | 3/1993 | Minor et al. | |
| 5,213,164 | A | 5/1993 | Mork | |
| 5,289,880 | A | 3/1994 | Barto | |
| 5,511,625 | A | 4/1996 | Mork | |
| 5,890,546 | A | 4/1999 | Kerpash, Sr. | |
| 6,032,746 | A | 3/2000 | Lowery | |
| 6,206,106 | B1 | 3/2001 | Heckendorf | |
| 6,347,670 | B1 | 2/2002 | Miskin | |
| 6,615,929 | B2 | 9/2003 | Heckendorf | |
| 6,904,979 | B1 | 6/2005 | Confoey | |
| 7,063,166 | B1 | 6/2006 | Grosberg | |
| 7,325,636 | B2 | 2/2008 | Yeoman et al. | |
| 7,600,576 | B2 | 10/2009 | Gayer | |
| 7,712,559 | B2 | 5/2010 | Yeoman et al. | |
| 7,849,932 | B2 | 12/2010 | Friggstad et al. | |
| 7,980,282 | B2 | 7/2011 | Moyna et al. | |
| 7,980,319 | B2 | 7/2011 | Maeda | |
| 8,544,558 | B1 | 10/2013 | Seal | |
| 2006/0081385 | A1* | 4/2006 | Huber | 172/684.5 |
| 2013/0283746 | A1* | 10/2013 | Chan et al. | 56/10.7 |

* cited by examiner

TONGUE PULLED SPREADER AND GRADER WITH AUXILIARY ELECTRIC MOTOR FOR LOWERING OR RAISING WHEELS

CROSS-REFERENCE TO RELATED APPLICATIONS

This is a continuation of U.S. patent application Ser. No. 12/948,963, filed Nov. 18, 2010 (issuing as U.S. Pat. No. 8,544,558 on Oct. 1, 2013), which is a nonprovisional of U.S. Provisional Patent Application Ser. No. 61/403,878, filed on Sep. 23, 2010, both of which of are hereby incorporated herein by reference.

Priority of U.S. patent application Ser. No. 12/948,963, filed Nov. 18, 2010 and U.S. Provisional Patent Application Ser. No. 61/403,878, filed on Sep. 23, 2010 is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to graders. More particularly, the present invention relates to a tongue pulled/improved spreader/grader of the type pulled by a ATV, Lawn Tractor, or other motorized vehicle having a Tongue system that connects to the desired vehicle to pull it. The tongue system has an adjustment system to control the grader's pitch. The means of adjustment can be manually, mechanically or hydraulically. The tongue pulled spreader grader contains an axle and tire system that can be used to raise and lower the grader. The axle and wheel system can be raised and lowered manually, mechanically, or hydraulically.

2. General Background of the Invention

There are many types of spreader/graders in the industry which are pulled usually by a vehicle, such as a truck or tractor equipped to pull the grader along the ground. However, there is a need in the industry to provide a tongue pulled spreader/grader which can attach to and be operated by ATVs, SUVs, light trucks, lawn tractors, sub compact tractors, side by side ATVs and but not limited to fork trucks. Such a spreader/grader would be very beneficial to be able to be pulled by such a variety of vehicles. Also, rather than the spreader/grader having to be hauled on the back of a flat bed truck or the like, it would be even more beneficial to provide a spreader/grader which would have the capability to be converted from a spreader/grader for grading to a spreader/grader which would have a system of wheels which could be maneuvered upward and downward, so that in the up position the spreader/grader is set to grade, but in the down position, the wheels would rest on the ground, with the grader raised above the ground, and the grader could be pulled to various locations without the need to place the grader on another vehicle, but pulled by the same vehicle which pulled the spreader/grader while it was grading.

BRIEF SUMMARY OF THE INVENTION

The apparatus of the present invention is designed to be pulled and or be use by any vehicle having a means to tow a spreader/grader but the vehicle does not have means to connect to and operate a conventional spreader/grader, such as an 3-point hitch with hydraulic lift systems built into it such as ones found on farm tractors. The tongue pulled spreader/grader can attach to and be operated by ATVs, SUVs, light trucks, lawn tractors, sub compact tractors, side by side ATVs and but not limited to fork trucks.

What is provided is an improved spreader/grader system having a pair of spaced apart sidewalls and cross beams to define a frame portion, a plurality of moveable or fixed blades extending between the sidewalls, each of the blades positionable along the length of each sidewall and fixed in a position at a predetermined angle; a means for mounting the frame to the rear of a vehicle, of the type discussed above; a pair of wheels positioned on an axle on either side of the sidewalls; means for manually or hydraulically extending the wheels to a down position to make contact with a surface in order to transport the spreader/grader and for retracting the wheels to an up position so that the spreader/grader can be used to undertake the grading process.

Therefore, it is a principal object of the present invention to provide a tongue pulled spreader/grader which can attach to and be operated by ATVs, SUVs, light trucks lawn tractors, subcompact tractors, side by side ATVs, and which has the capability to be transported on a pair of wheels mechanically or hydraulically moveable from a first down position wherein the wheels make contact with the ground during transport, to an up position where the wheels are away from the ground, and the spreader/grader blades contact the ground to undertake the spreading and grading process.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
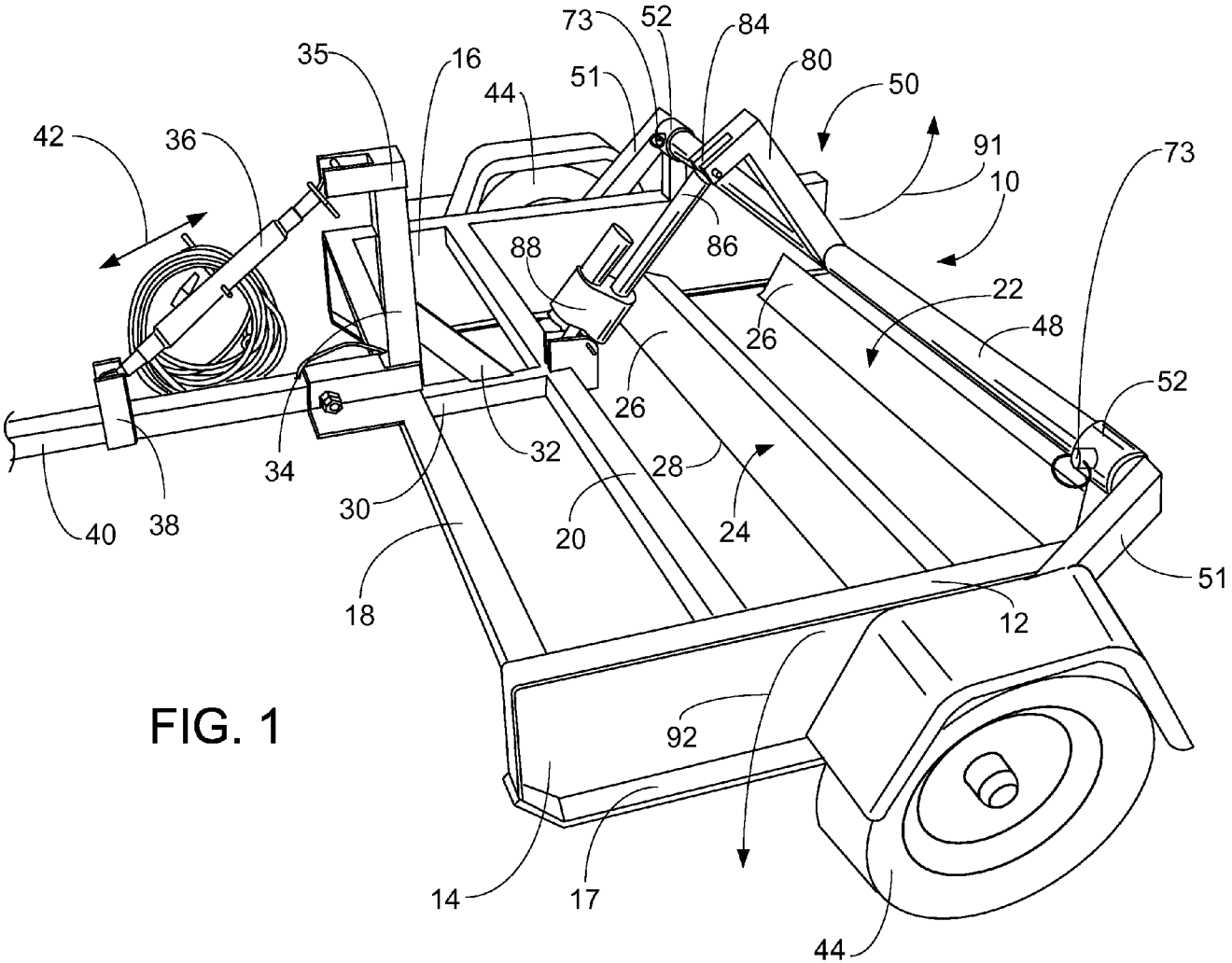
FIG. 1 illustrates an overall view of the preferred embodiment of the tongue pulled spreader/grader of the present invention utilizing mechanical means to move the wheel assembly.
Figure 2:
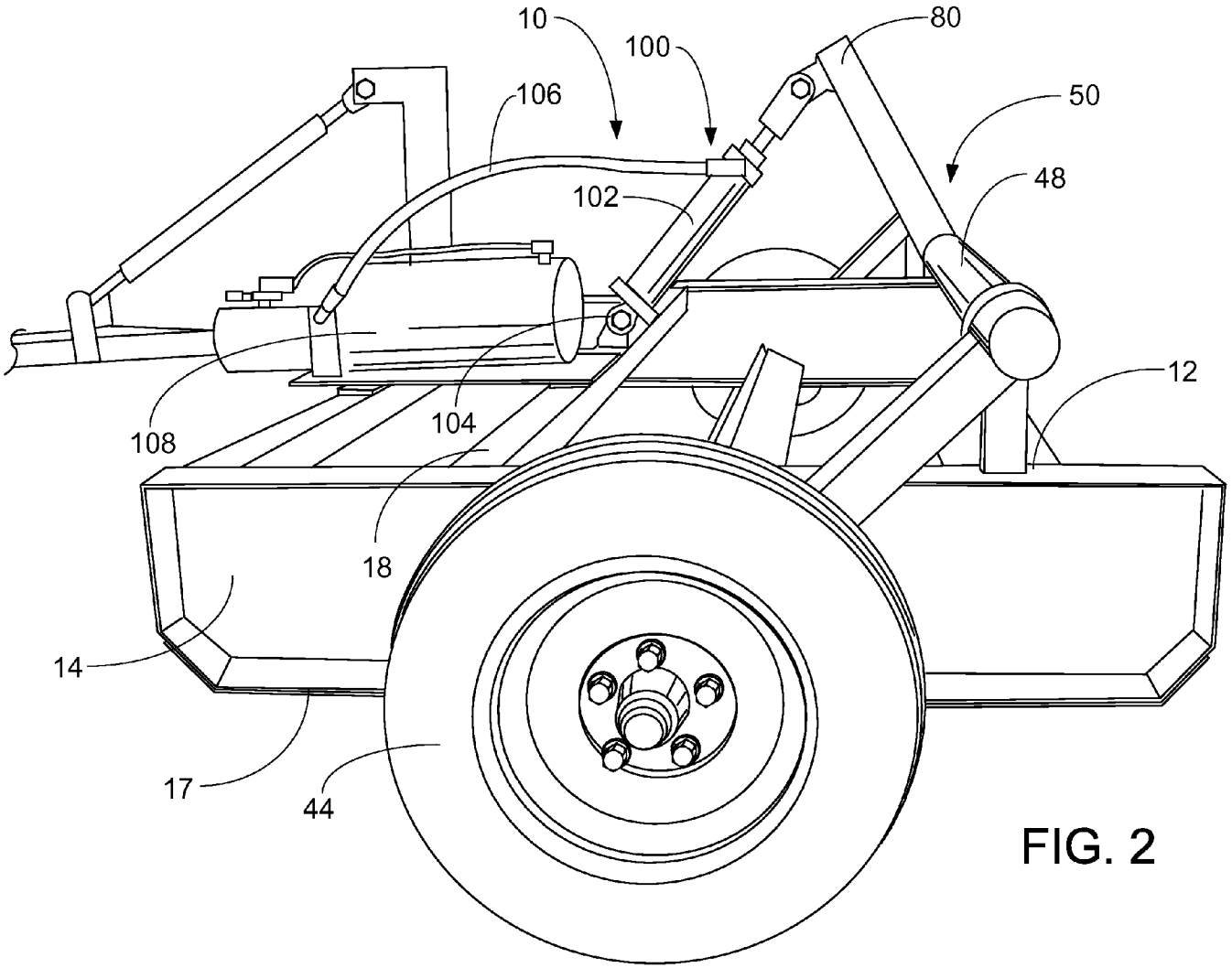
FIG. 2 illustrates a side view of the preferred embodiment of the tongue pulled spreader/grader of the present invention utilizing hydraulic tower to move the wheel assembly.
Figure 3:
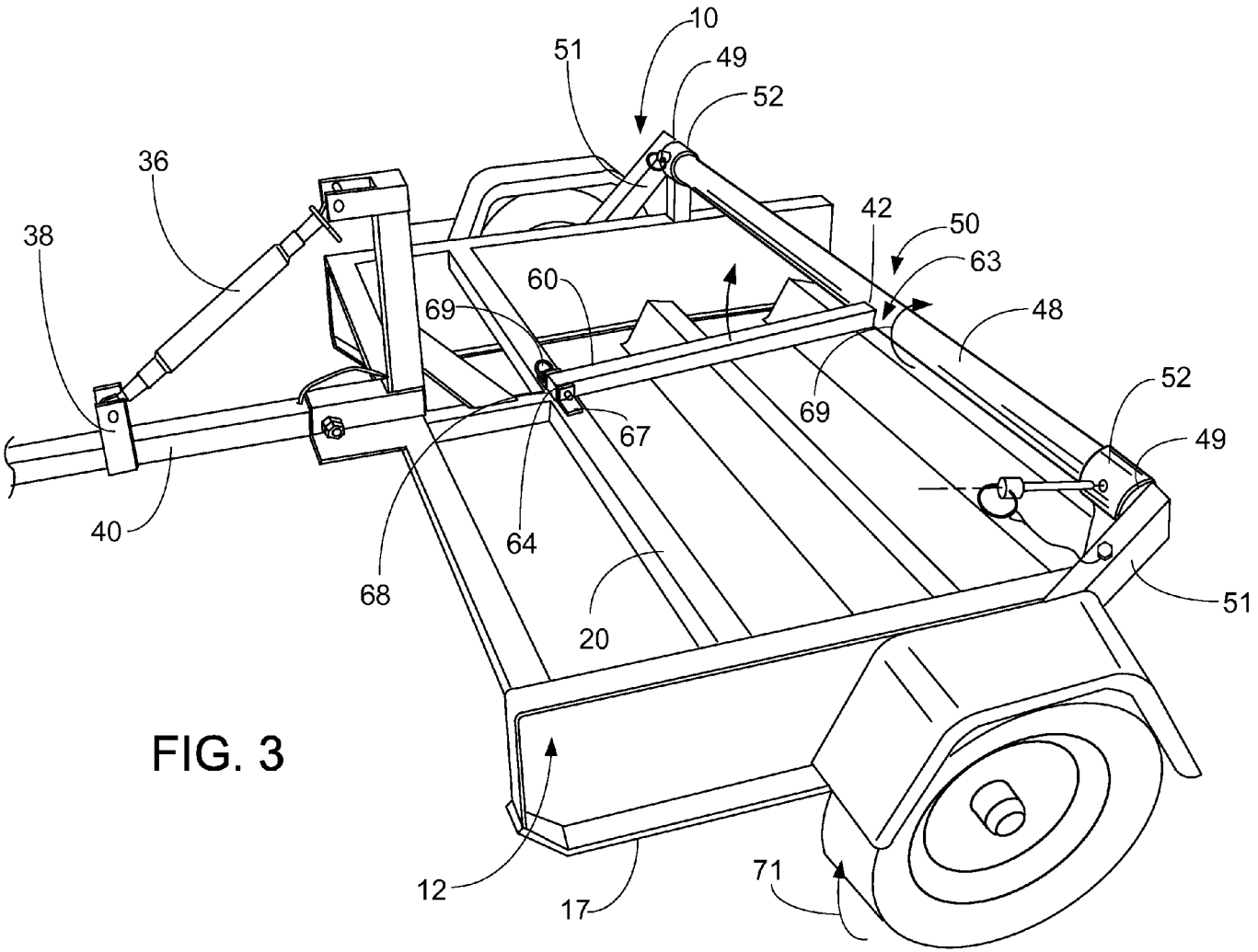
FIG. 3 illustrates an overall view of the wheel lifting mechanism in the preferred embodiment of the tongue pulled spreader/grader of the present invention utilizing manual power to move the wheel assembly.

Without departing from the principle of the invention, and without limitation to other embodiments differing in size, scope of the spreader/grader, and prior to a discussion of the FIGS. 1 through 10, an exemplary embodiment of the present invention will be described by way of example only. It should be noted that the present invention provides a spreader grader which has a means for adjusting the pitch of the spreader/grader and a means for moving a wheel assembly, as will be discussed and defined further, between up and down positions. FIG. 1 illustrates the first means, which is a mechanical means, as set forth below; FIG. 2, and other figures illustrate the second means, which is the hydraulically powered means, and FIG. 3 illustrates the manual means for moving the wheel assembly 50. These will be discussed below.

FIGS. 1 through 10 illustrate the preferred embodiment of the improved spreader/grader system 10 of the present invention, sometimes referred to as the system 10.

As seen in overall view in FIG. 1, the spreader/grader system 10 overall comprises a generally rectangular metal frame 12, having a pair of sidewalls 14, 16, with the sidewalls 14, 16 spaced apart by a first forward cross member 18, a rear cross member 20. There is further provided at least two blade assemblies 22, 24, each assembly 22, 24 having a cutting blade 26 mounted thereon along substantially the entire length of each assembly 22, 24, and having a spreading/cutting edge 28 for undertaking the spreading and grading process when the system 10 is in use. The bottom surface of each sidewall 14, 16 has mounted thereon replaceable wear shoes 17, which are dragged along the ground being graded, and can be replaced when worn.

There is further provided a member 30 positioned along the midpoint of and secured between the forward cross member 18 and rear cross member 20. Member 30 supports a brace 32 which is supporting an upright brace 34. The upper end 35 of brace 34 engages the first end of adjustable bar member 36, while the second end of adjustable bar member 36 is secured to a bracket 38 positioned on the tongue 40 of the system 10. Tongue 40 would be a typical tongue known in the industry which would have a distal end (not illustrated) which connects to a vehicle which could transport or pull spreader/grader 10, such as, but not limited to an ATV, SUV, light truck, lawn tractor, subcompact tractor, side by side ATV, or any other vehicle to which the end of tongue 40 could be secured. The second end of the tongue 40 is secured to the frame 10 at bracket 41, with nut/bold assembly 43. This is seen in greater detail in isolated view in FIG. 6. The adjustable bar member 36 would be utilized to change the pitch of the grader and the cutting depth of the cutting blades 26 during use, by extending or retracting the length of the adjustable bar 36 in the direction of arrows 42. The adjustability of the bar 36 in may be done mechanically, manually, or hydraulically, depending on the choice of the operator of the system 10.

Turning now to the movement of the wheel assembly 50 of the present invention, reference is made to FIG. 1 where the movement is done mechanically. For future reference, wheel assembly 50 is defined as the pair of wheels 44 secured to the ends of axle 48, which is mounted to each wheel 44 via the brace 51 secured between the axle 48 and each wheel 44, so that when the axle 48 is rotated on bushings 52, the wheels 44 are likewise rotated. This relationship is seen in isolated views in FIG. 7.

FIG. 1 illustrates a pair of wheels 44, mounted on an axle 48, the wheels 44 positioned on the outer face of each sidewalls 14, 16, which would describe the wheel assembly 50. The positioning of the wheels 44 as part of assembly 50 will be discussed in detail below. As seen in FIG. 1, wheel assembly 50, as defined earlier, would include a brace 80 mounted at the midpoint of axle 48, terminating in an upper end 82, wherein a bracket 84 engages the upper end of an arm 86 which extends from a motor 88. When the motor 88 is powered by, for example, electric tower through electrical line 89, the arm 86 extends outward in the direction of arrow 91, and in doing so forces the brace 80 upward which imparts rotation of axle 48 in bushings 52, which in turn rotates wheels 44 upward and no longer contacting the ground 46. Likewise, when the motor 88 would be reversed, the arm 86 would retract, rotating the axle in the opposite direction, thus moving the wheels 44 down in the direction of arrow 92, and the wheels 44 in the down position would rest on the ground 46.

Before a discussion had regarding the movement of the wheels 44 between the up and down positions through hydraulic means, which is the preferred means, reference is made to FIG. 3 which illustrates the embodiment of the system 10 wherein the wheels are moved from the up and down positions manually. As seen in FIG. 3, there is provided an axle 48 which extends above the frame 12, and each end 49 of the axle 48 extending beyond each sidewall 14, 16. There is provided a brace 51 extending from the end 49 of the axle 48, the brace 51 having a second end engaging a spindle 53 on each wheel 44, as seen in detail view in FIG. 7. The axle 48 also includes a bushing 52 adjacent each end, as seen in FIG. 3. As part of the wheel lifting assembly 50, there is a center brace 60 having a first end 62 connected to the center point 63 of the axle 48, and a second end 64 pivotally mounted to a bracket 67 at the center point 68 of the rear cross member 20. As illustrated the second end 64 is secured to the bracket 67 via a cotter pin 69, which allows the center brace 60 to pivot.

Figure 5:
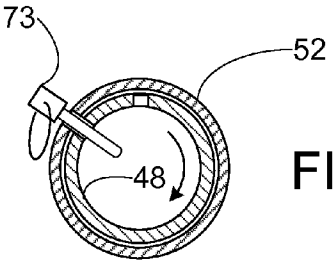
FIGS. 4 and 5 illustrate cross-section views of the locking mechanism maintaining the wheels in the raised or lowered position during use of transport of the spreader/grader.
Figure 7:
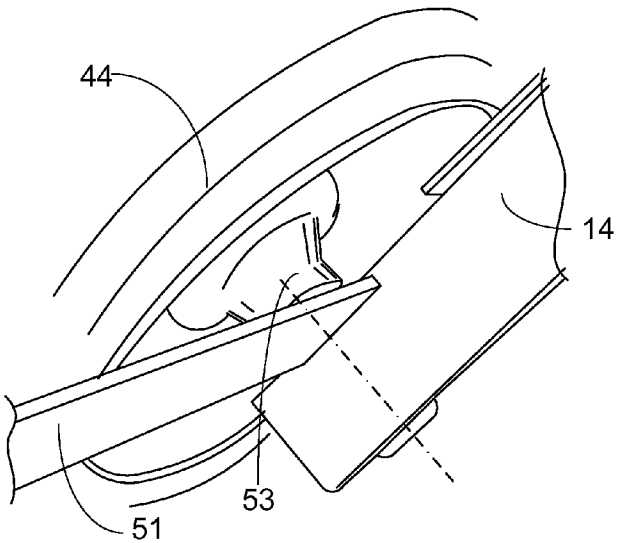
FIG. 7 illustrates an isolated view of the attachment between the wheels and the brace of the wheel assembly in the spreader/grader of the present invention.
Figure 4:
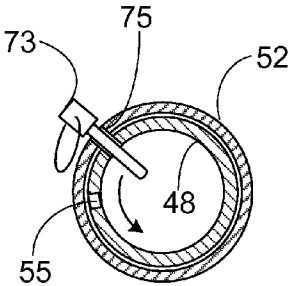
Figure 6:
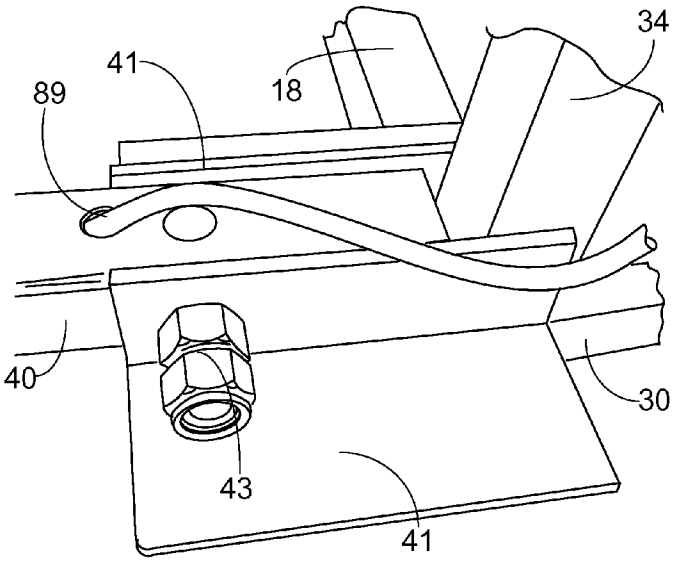
FIG. 6 illustrates an isolated view of the hydraulic line providing hydraulic fluid to the hydraulic cylinder which raises and lowers the wheels between up and down positions.

In operation, as seen in FIG. 3, and in isolated views in FIGS. 4 and 5, the wheels 44 are locked in the down position via a pin 73 inserted into an opening 75 in each bushing 52 and further into an opening 55 in the wall of the axle 48. When one wishes to raise the wheels 44 manually, the pins 73 are removed, then the axle 48 can rotated in the direction of arrows 69, and the wheels 44 are rotated within bushings 52 upward in the direction of arrows 71, and would no longer make contact with the ground. In order to secure the wheels 44 in place in the up position, pins 73 at each end are inserted through a second opening 75 in each bushing 52, and further into an opening 55 in the wall of axle 48, so as to lock the wheels 44 in place while the pins 73 are in place. When the pins 73 are removed, the wheels can be lowered back into the position as seen in FIG. 3, and the pins 73 are re-inserted into the opening which will lock the wheels 44 in the down position.

Figure 8:
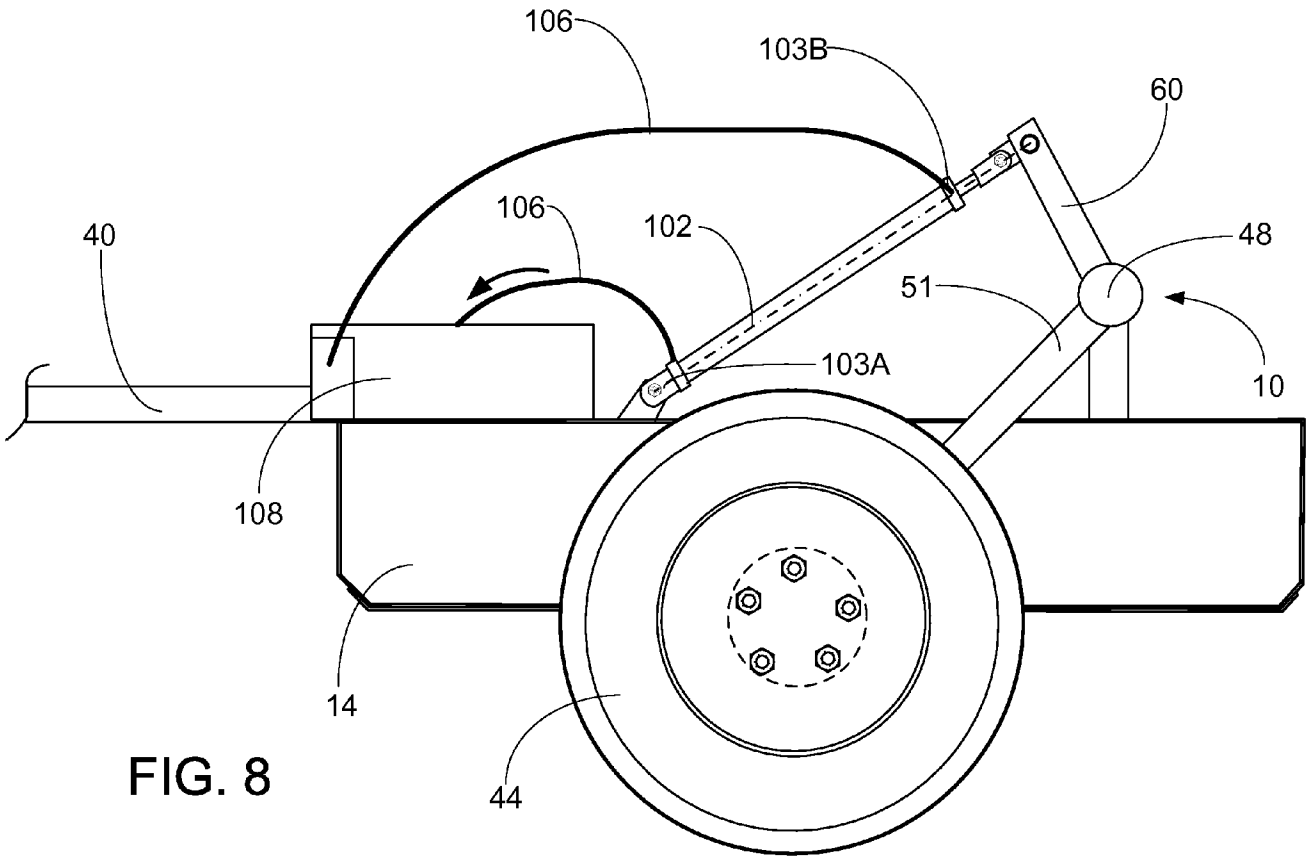
FIG. 8 illustrates a side view of the hydraulic powered assembly for hydraulically lifting or lowering the wheels in the spreader/grader of the present invention.
Figure 9:
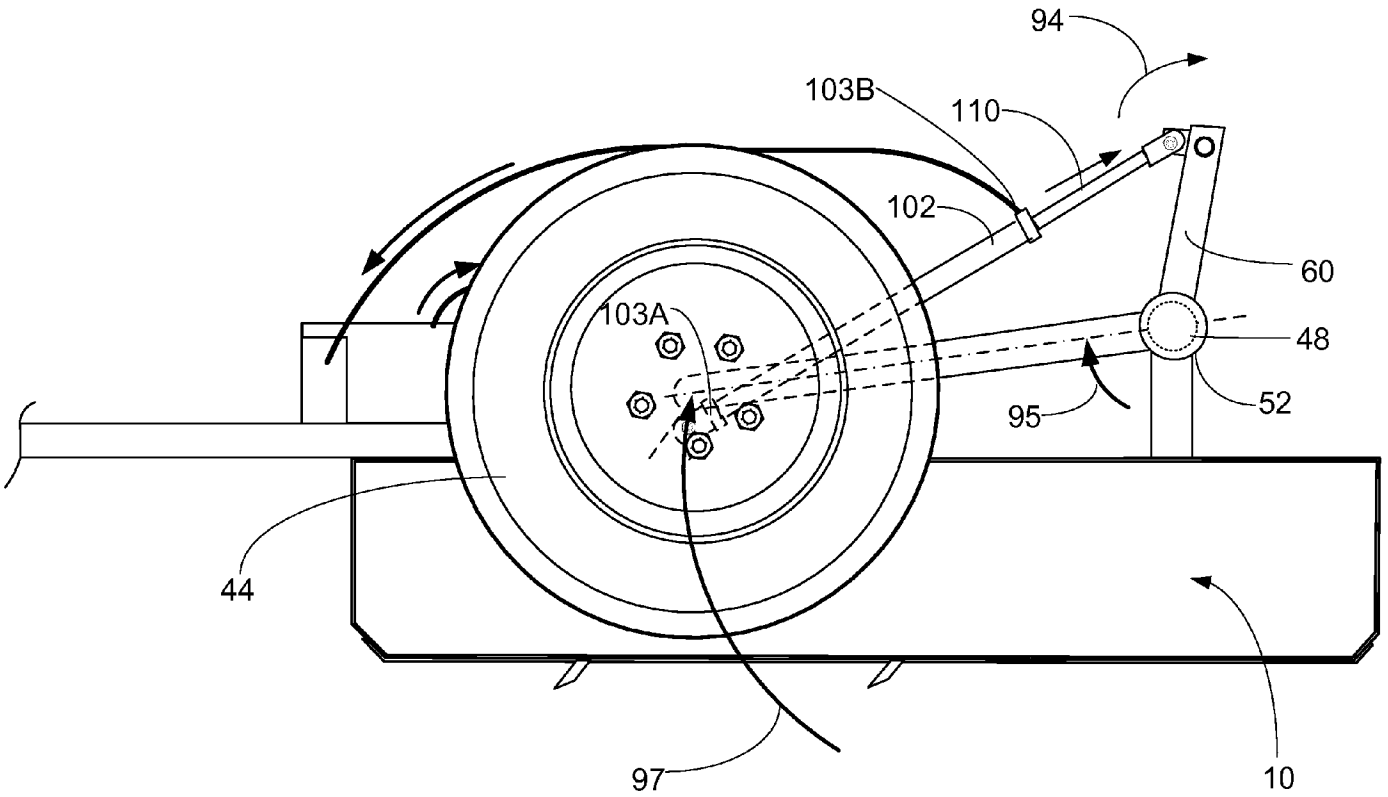
FIG. 9 illustrates a side view of the tires moved to the up position from the down position as seen in FIG. 8.

Reference is now made to FIG. 2, and FIGS. 8 through 10 which will be used to discuss the important feature of the spreader/grader system for allowing the wheels 44 to be moved hydraulically by the operator. As seen in FIG. 2, the wheels 44 are in a first down position, where wheels 44 are making contact with the ground 46. Whereas, as seen in FIG. 9, the wheels 44 have been retracted to the second up position, where the wheels 44 make no contact with the ground 46. In this position the spreader/grader frame 12 is resting on the ground 46, with the cutting blades 26 in position to spread or grade along the surface of the ground 46, when the spreader/grader 10 is pulled along the surface.

Continuing with FIG. 2 and FIGS. 8 through 10, these figures depict the same movement of the wheel assembly 50, as described in FIGS. 1 and 3, except that the wheel assembly 50 is being moved between up and down positions via a hydraulic means 100. This means 100 comprises a hydraulic cylinder 102 positioned between the upper end 82 of brace 50, mounted on axle 48. The second end of hydraulic cylinder 102 would be secured to a bracket 104 on cross member 18. As seen, there is provided a line 106 for transporting hydraulic fluid from a hydraulic pump 108, mounted on the frame 12 to the hydraulic cylinder 102. Pump 108 would obtain its fluid from a hydraulic tank (not illustrated) mounted on the vehicle pulling the system 10.

Figure 10:
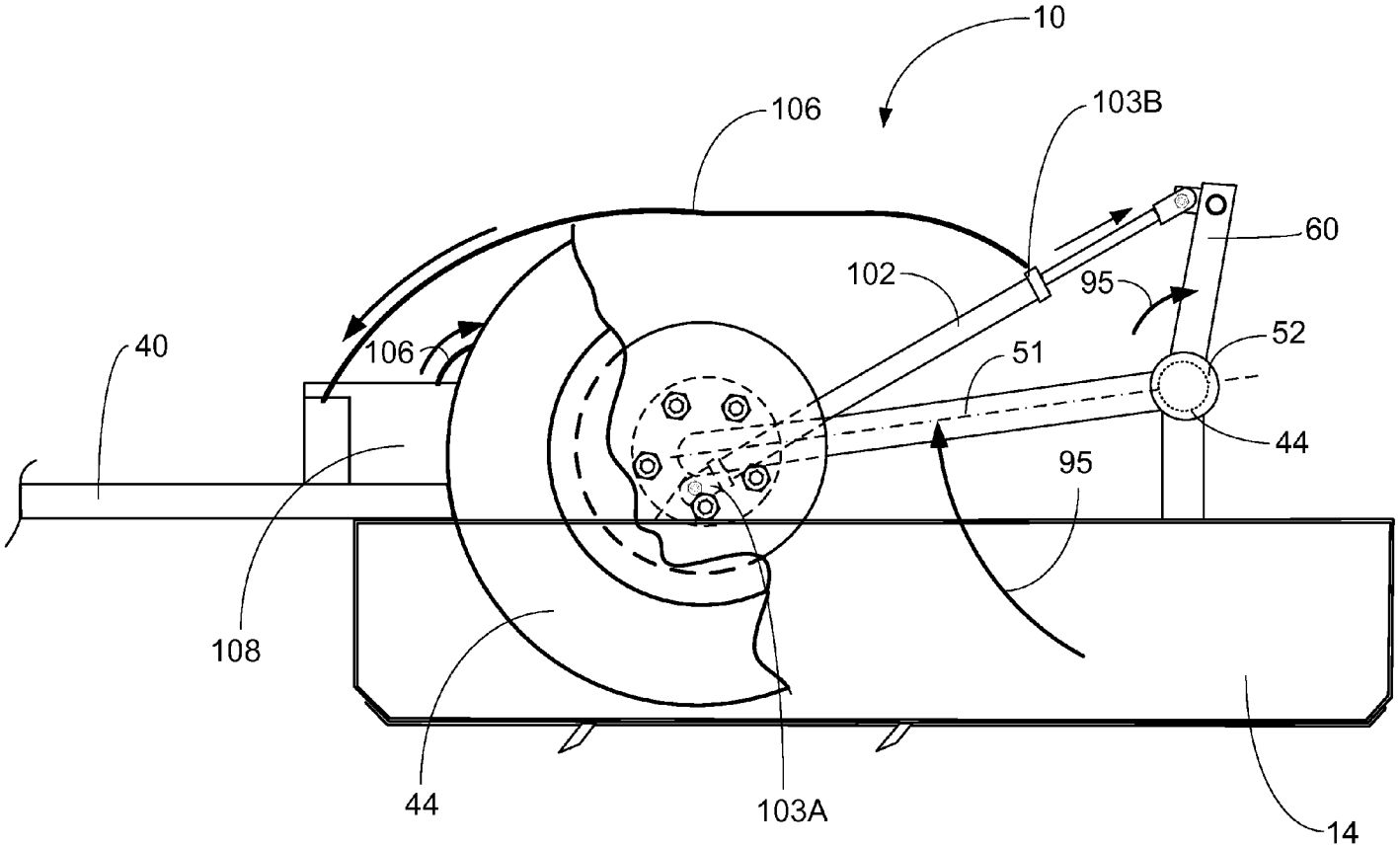
FIG. 10 illustrates the tires locked into the up position while the spreader/grader is undertaking a grading task.

During operation, FIG. 8 illustrates the system 10, with the hydraulic cylinder 102 receiving fluid on both ends 103A and 103B, via lines 106 from pump 108, with the wheels 44 in the down position. In FIGS. 9 and 10, when fluid is pumped into a first end 103A, the rod 110 within the cylinder 102 is pushed out by the fluid, and when this occurs, brace 60 is moved back in the direction of arrow 94; which rotates brace 51 in the direction of arrow 95, which raises the wheels 44 upward as seen in FIGS. 9 and 10, and which allows cutting blades 26 to engage the surface 46 to start the grading process. Likewise, when grading is complete, and the system 10 needs to be transported to another site, hydraulic fluid is pumped into end 103B, which forces the rod 110 back into the cylinder 102, which in turns moves the brace 60 forward and rotates the wheels downward to re-engage the surface 46 for transport.

In each of the embodiments as discussed above, it is foreseen that the tongue-pulled grader may have other features, such as a plurality of blades set in both parallel and non-parallel positions between sidewalls 12, 14 of the spreader/grader 10. Also, it may be that the blades of the spreader/grader 10 may not be fixed in place by welding, but may be bolted in place so that the blades 26 can be re-positioned for certain tasks. Further, it may be that one or more of the blades may be moved hydraulically by the operator, so that manual positioning of the blades is avoided, but can be done by the operator while seated on the transport vehicle.

The following is a list of parts and materials suitable for use in the present invention.

PARTS LIST

| Parts Number | Description |
|---|---|
| 10 | system |
| 12 | metal frame |
| 14, 16 | side walls |
| 17 | replaceable wear shoes |
| 18 | forward cross member |
| 20 | rear cross member |
| 22, 24 | blade assemblies |
| 26 | cutting blade |
| 28 | cutting edge |
| 30 | member |
| 32 | brace |
| 34 | brace |
| 35 | upper end |
| 36 | adjustable bar member |
| 38 | bracket |
| 40 | tongue |
| 41 | bracket |
| 43 | nut/bolt assembly |
| 42 | arrow |
| 44 | wheels |
| 46 | ground/surface |
| 48 | axle |
| 49 | end |
| 50 | wheel assembly |
| 51 | brace |
| 52 | bushings |
| 53 | spindle |
| 55 | opening |
| 60 | center brace |
| 62 | first end |
| 63 | center point |

-continued

PARTS LIST

| Parts Number | Description |
|---|---|
| 64 | second end |
| 67 | bracket |
| 68 | center point |
| 69 | cotter pin |
| 71 | arrow |
| 73 | pin |
| 75 | opening |
| 80 | brace |
| 82 | upper end |
| 84 | bracket |
| 86 | arm |
| 88 | motor |
| 89 | electrical line |
| 91 | arrow |
| 94 | arrow |
| 95 | arrow |
| 100 | hydraulic means |
| 102 | hydraulic cylinder |
| 103A, 103B | hydraulic cylinder ends |
| 106 | lines |
| 108 | pump |
| 110 | rod |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A tongue-pulled spreader and grader system, comprising:

a. a frame, having a pair of spaced apart sidewalls;

b. at least one blade positioned between the sidewalls for making contact to a surface to be graded;

c. an axle spanning across and positioned above the sidewalls, the axle having first and second ends;

d. a brace mounted on each of the first and second ends of the axle, at a first end of each brace, with a second end of each brace being secured to a rotatable wheel;

e. a mounting member extending from a midpoint of the axle at a first end of the mounting member and pivotably mounted to a cross brace secured to the frame at a second end of the mounting member;

f. a mechanically electrically driven motor mounted on the frame and connecting to the mounting member for imparting movement to the mounting member which imparts rotational movement to the axle so that the wheels are rotated upward from a first position resting on the surface to a second position above the surface and above a level of the blade, wherein the blade is simultaneously lowered to cut into the surface as the frame is pulled along the surface; and g. the electrically driven motor further imparting rotation of the axle in an opposite direction to move the wheels from the second position above the blade to return to the first position resting on the surface wherein the at least one blade is also simultaneously raised to a position no longer in contact with the surface.

2. The spreader and grader system in claim 1, wherein there is provided a plurality of fixed blades mounted to the sidewalls of the frame.

3. The spreader and grader spreader system in claim 1, further comprising a tongue component mounted to the frame for attaching the spreader and grader system to ATVs, SUVs, light trucks, fork trucks, lawn tractors, sub compact tractors, or side by side ATVs.

4. The spreader and grader system in claim 1, wherein the axle rotates within a pair of bushings at each end of the axle.

5. The spreader and grader system in claim 4, wherein there is further provided pins insertable in openings in the bushings and axle wall in order to maintain the wheels in the up or down position as desired.

6. The spreader and grader system in claim 1, wherein there are multiple blades that may be fixed in place or moveable in various parallel or nonparallel positions.

7. The spreader and grader system of claim 3 further comprising an adjustable means extending between the tongue component and frame, wherein the adjustable means is configured to change the frame's pitch and depth of the at least one blades.

8. The spreader and grader system in claim 1, further comprising an electrical line for providing power to the motor for operation of the spreader and grader by an ATV, SUV, light truck, fork truck, lawn tractor, sub compact tractor, or side by side ATVs.

9. A spreader and grader system, comprising:

a. a frame, having a pair of spaced apart sidewalls;

b. one or more blades positioned between the sidewalls for making contact to a surface;

c. an axle having first and second ends spanning across and positioned above the sidewalls;

d. a brace mounted on each of the first and second ends of the axle at a first end of each brace and secured to a rotatable wheel at a second end of each brace;

e. a mounting member extending from a midpoint of the axle at a first end of the mounting member and pivotably mounted to a cross brace secured to the frame at a second end of the mounting member;

f. an electrically driven motor mounted on the frame, the electrically driven motor connecting to the mounting member for imparting movement to the mounting member for imparting rotational movement to the axle so that the wheels are rotated upward from a first position resting on the surface to a second position above the surface and above the one or more blades to lower the one or more blades to cut into the surface, as the frame is pulled along the surface;

g. the electrically driven motor further imparting rotation of the axle in an opposite direction to move the wheels from the second position above the one or more blades to return to the first position resting on the surface wherein the one or more blades are raised to a position no longer in contact with the surface.

10. The spreader and grader system in claim 9, wherein there are multiple blades that may be fixed in place or moveable in various parallel or nonparallel positions.

11. The spreader and grader of claim 9, further comprising a tongue component mounted to the frame for enabling the spreader and grader to attach to and be operated by ATVs, SUVs, light trucks, fork trucks, lawn tractors, sub compact tractors, or side by side ATVs.

12. The spreader and grader system in claim 11 further comprising an adjustable means extending between the tongue component and frame, wherein the adjustable means is configured to change the frame's pitch and depth of the one or more blades.

13. A spreader and grader system, comprising:

a. a frame, having a pair of spaced apart sidewalls;

b. at least one blade positioned between the sidewalls for making contact to a surface;

c. an axle having first and second ends spanning across and positioned above the sidewalls;

d. a brace mounted on each of the first and second ends of the axle at a first end of each brace and secured to a rotatable wheel at a second end of each brace;

e. a mounting member extending from a midpoint of the axle at a first end of the mounting member and pivotably mounted to a cross brace secured to the frame at a second end of the mounting member;

f. a motor, powered by an electrical line, wherein the motor is mounted on the frame and connected to the mounting member for imparting movement to the mounting member which imparts rotational movement to the axle so that the wheels are rotated upward from a first position resting on the surface to a second position above the surface and above the blade to allow the blade to cut into the surface as the frame is pulled along the surface;

g. the motor further imparting rotation of the axle in an opposite direction to move the wheels from the second position above the blade to return to the first position resting on the surface; and h. the spreader and grader operable by an electrical tower providing power to the electrical line.

14. The spreader and grader system of claim 13, wherein there are multiple cutting blades that may be fixed in place or moveable in various parallel or nonparallel positions.

15. The spreader and grader of claim 13, further comprising a tongue component mounted to the frame in order for the spreader and grader to attach to and be operated by ATVs, SUVs, light trucks, lawn tractors, sub compact tractors, or side by side ATVs.

16. The spreader and grader system of claim 15 further comprising an adjustable means extending between the tongue component and frame, wherein the adjustable means is configured to change the pitch of the grader and depth of the at least one blade.

* * * * *